US009310136B2

(12) United States Patent
Andersson et al.

(10) Patent No.: US 9,310,136 B2
(45) Date of Patent: Apr. 12, 2016

(54) PORT OPENING OF HEAT EXCHANGER

(75) Inventors: Sven Andersson, Hässleholm (SE); Svante Hoberg, Åstorp (SE); Tomas Dahlberg, Helsingborg (SE)

(73) Assignee: SWEP International AB, Landskrona (SE)

( * ) Notice: Subject to any disclaimer, the term of this patent is extended or adjusted under 35 U.S.C. 154(b) by 351 days.

(21) Appl. No.: 13/139,681

(22) PCT Filed: Dec. 11, 2009

(86) PCT No.: PCT/EP2009/066929

§ 371 (c)(1),
(2), (4) Date: Sep. 12, 2011

(87) PCT Pub. No.: WO2010/069872

PCT Pub. Date: Jun. 24, 2010

(65) Prior Publication Data

US 2011/0308779 A1 Dec. 22, 2011

(30) Foreign Application Priority Data

Dec. 17, 2008 (SE) ..... 0802597

(51) Int. Cl.

| | |
|---|---|
| ***F28D 7/02*** | (2006.01) |
| ***F28F 3/08*** | (2006.01) |
| ***F28F 9/02*** | (2006.01) |
| ***F28D 9/00*** | (2006.01) |
| ***F28F 3/04*** | (2006.01) |

(52) U.S. Cl.

CPC ..... *F28D 9/005* (2013.01); *F28F 3/046* (2013.01); *F28F 2225/00* (2013.01)

(58) Field of Classification Search

CPC ..... F28D 9/005; F28D 9/0043; F28D 1/0325; F28D 1/0375; F28F 3/046; F28F 9/0278; F28F 9/026; F28F 3/086; F28F 9/0265

USPC ..... 165/166, 167

See application file for complete search history.

(56) References Cited

U.S. PATENT DOCUMENTS

| | | | | |
|---|---|---|---|---|
| 4,182,411 | A * | 1/1980 | Sumitomo et al. | 165/110 |
| 4,270,602 | A * | 6/1981 | Foster | 165/167 |

(Continued)

FOREIGN PATENT DOCUMENTS

| | | |
|---|---|---|
| DE | 199 39 264 | 2/2001 |
| GB | 134277 | 4/1919 |

(Continued)

OTHER PUBLICATIONS

International Search Report for International Application No. PCT/EP2009/066929 mailed Apr. 21, 2010 (Form PCT/ISA/210).

(Continued)

*Primary Examiner* — Allen Flanigan
*Assistant Examiner* — Jason Thompson
(74) *Attorney, Agent, or Firm* — Merchant & Gould P.C.

(57) ABSTRACT

A brazed heat exchanger (100,200) for exchanging heat between fluids comprises a number of heat exchanging plates (110,210) provided with a pressed pattern of ridges (120,220) and grooves (130,230). The heat exchanger plates (110,210) are stacked onto one another such that flow channels (211, 212) are formed between said plates (110,210), and the flow channels (211,212) are in selective communication with port openings (140,240). Port skirts (170,250,260) are arranged on the heat exchanging plates (110,210), said port skirts (170, 250, 260) at least partly surrounding the port openings (140, 240), extending in a generally perpendicular direction as compared to a plane of the heat exchanger plates (110,210) and being arranged to overlap one another to form a pipe like configuration or a part thereof.

4 Claims, 2 Drawing Sheets

(56) References Cited

U.S. PATENT DOCUMENTS

| | | | | |
|---|---|---|---|---|
| 5,125,453 | A * | 6/1992 | Bertrand et al. | 165/153 |
| 5,226,474 | A * | 7/1993 | Hallgren | 165/110 |
| 5,794,691 | A | 8/1998 | Evans et al. | |
| 6,161,615 | A * | 12/2000 | Brieden et al. | 165/166 |
| 6,340,054 | B1 | 1/2002 | Schwarz et al. | |
| 6,478,080 | B2 * | 11/2002 | Pinto | 165/153 |
| 8,167,029 | B2 | 5/2012 | Bertilsson et al. | |
| 2004/0134637 | A1 | 7/2004 | Helin et al. | |
| 2005/0082049 | A1 * | 4/2005 | Brost | 165/166 |
| 2005/0194123 | A1 * | 9/2005 | Strahle et al. | 165/167 |
| 2008/0283232 | A1 * | 11/2008 | Grozinger et al. | 165/167 |

FOREIGN PATENT DOCUMENTS

| | | |
|---|---|---|
| GB | 134277 | 10/1919 |
| JP | 59-170285 | 11/1984 |
| JP | 61-89681 | 6/1986 |
| JP | 61-183984 | 11/1986 |
| JP | 63-90763 | 6/1988 |
| JP | 2000-320986 | 11/2000 |
| JP | 2001-526765 | 12/2001 |
| JP | 2008-536090 | 9/2008 |
| WO | WO 2006/110090 | 10/2006 |
| WO | WO 2007/031229 | 3/2007 |

OTHER PUBLICATIONS

International Written Opinion for International Application No. PCT/EP2009/066929 (Form PCT/ISA/237).

Swedish Office Action for corresponding Swedish Application No. 0802597-5 mailed Jun. 1 2009.

Japanese Office Action for JP 2011-541354 dated Oct. 8, 2013 with English translation (6 pages).

* cited by examiner

PORT OPENING OF HEAT EXCHANGER

This application is a National Stage Application of PCT/EP2009/066929, filed 11 Dec. 2009, which claims benefit of Serial No. 0802597-5, filed 17 Dec. 2008 in Sweden and which applications are incorporated herein by reference. To the extent appropriate, a claim of priority is made to each of the above disclosed applications.

FIELD OF THE INVENTION

The present invention relates to a brazed heat exchanger for exchanging heat between fluids, the heat exchanger comprising a number of heat exchanging plates provided with a pressed pattern of ridges and grooves, wherein the heat exchanger plates are stacked onto one another such that flow channels are formed between said plates, said flow channels being in selective communication with port openings.

PRIOR ART

Heat exchangers are used for exchanging heat between fluid media, and generally comprise a number of plates stacked onto one another such that flow channels are formed between the plates. Usually, port openings are provided to allow selective fluid flow in and out from the flow channels. The selective fluid flow is in most heat exchangers provided by arranging the areas surrounding the port openings on different heights, such that areas surrounding the plates selectively engage one another to allow fluid flow to the flow channels or seal off the port opening from the flow channels.

US 2005/082049 discloses an alternative way of achieving selective sealing of the port openings from communication with the flow channels. In this document, the area around the port openings has been arranged on two levels, such that corresponding areas of neighboring plates contact one another to provide a seal. In order to arrange for communication, walls connecting said areas are provided with openings allowing flow from the port opening to the flow channels. The provision of the openings is intended to provide a desired deflection of the flow of media from the port opening to the flow channels.

A similar type of port opening design is shown in WO 2006/110090. However, the main reason for the design according to WO 2006/110090 is to provide a smooth surface in the port opening.

There are many types of heat exchangers on the market, for example tube and fin heat exchangers, air-liquid heat exchangers and plate heat exchangers.

Plate heat exchanger are often used for exchanging heat between two media in liquid form, but an emerging market for plate heat exchangers is heat pumps, wherein the plate heat exchanger is used for exchanging heat between a low temperature liquid (e.g. brine) and a coolant. Generally, such heat exchangers are designed to withstand a pressure of some tens of bars.

In recent years, there has been a general trend towards the use of carbon dioxide as the coolant in heat pump applications. There are some reasons that carbon dioxide has been a popular choice, mainly that the high temperature COP (efficiency) is high for carbon dioxide.

However, the use of carbon dioxide as the coolant means that the heat exchanger must withstand a high coolant pressure. Until now, no plate heat exchangers have been able to withstand such pressures.

A common way of manufacturing a plate heat exchanger is to braze the heat exchanger plates together to form the heat exchanger. Brazing a heat exchanger means that a surplus of a number of plates are provided with a brazing material, after which the plates are stacked onto one another and placed in a furnace having a temperature sufficiently hot to melt the brazing material. The melting of the brazing material means that the brazing material (partly due to capillary forces) will concentrate in areas where the heat exchanger plates are in close vicinity of one another, i.e. contact points between ridges and grooves of neighboring plates, and after the temperature of the furnace has been lowered, the brazing material will solidify, and the heat exchanger plates will be joined to one another to form a compact and strong heat exchanger.

It is well known by persons skilled in the art that brazed heat exchanger tend to break close to the port openings if subjected to high pressures. This is due to the fact that an internal pressure acts to tear brazed plates apart, and the tearing apart force is highest around the port openings, since the port opening represents a surface where the contact point concentration is low.

The object of the present invention is to provide a port opening of a brazed plate heat exchanger having an increased strength to withstand high internal pressures.

SUMMARY OF THE INVENTION

This and other objects of the invention is solved by port skirts arranged on the heat exchanging plates, said port skirts at least partly surrounding the port openings, extending in a general perpendicular direction as compared to a general plane of the heat exchanger plates and being arranged to contact one another to form a pipe.

In order to allow for fluid communication between port openings and flow channels, openings may be arranged between the port and the flow channels.

In order to increase the heat exchanging area compared to a prior art heat exchanger, only every other port skirt of the number of stacked heat exchanger plates may be provided with openings, such that a selective communication between the port opening and the flow channels is provided. In order to achieve this, the port skirt provided with the opening may also comprise a sealing surface.

BRIEF DESCRIPTION OF THE DRAWINGS

Hereinafter, the invention will be described with reference to the appended drawings, wherein.

DESCRIPTION OF EMBODIMENTS

Figure 1:
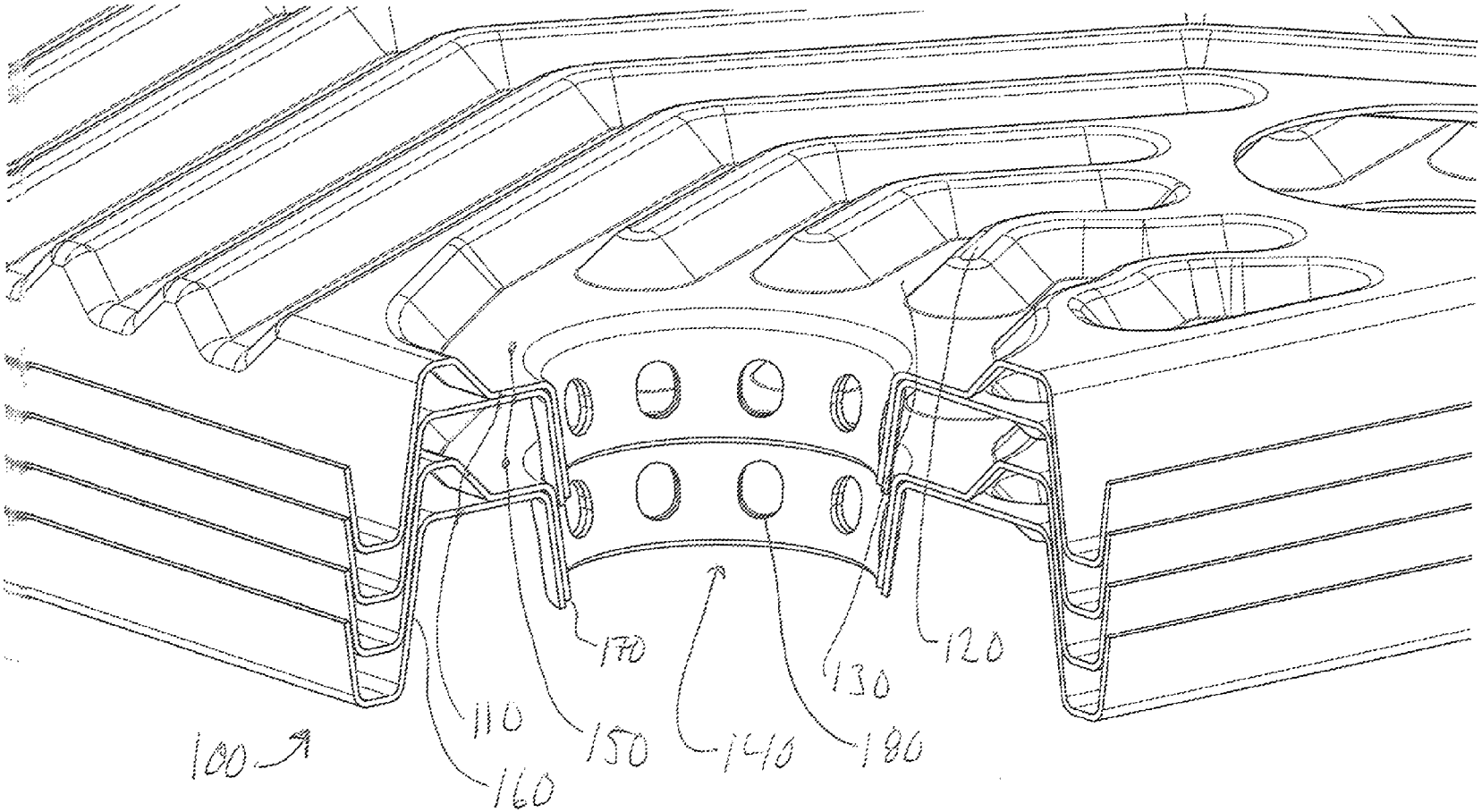
FIG. 1 is a partly sectioned perspective view of part of a heat exchanger exhibiting a first embodiment of a port opening according to the present invention.

In FIG. 1, a heat exchanger 100 according to a first embodiment of the present invention is shown. The heat exchanger 100 comprises a number of heat exchanger plates 110, which each comprises a pressed pattern of ridges 120 and grooves 130, which are adapted to form flow channels between neighboring plates as the plates are stacked onto one another. Moreover, the heat exchanger plates comprise port openings 140 (only one shown in FIG. 1). In the vicinity of the port openings, sealing surfaces 150 are arranged such that every other sealing surface having either of a large press depth or a small press depth neighbors a sealing surface of a neighboring plate having the opposite press depth. This arrangement results in a heat exchanger, wherein selective communication between port openings and flow channels is obtained.

A skirt 160 extends along the entire periphery of each heat exchanger plate 110. Skirts 160 of neighboring plates are adapted to form a seal by interaction between skirts of said neighboring heat exchanger plates.

Moreover, the heat exchanger plates of the first embodiment are each provided with a port skirt 170. The port skirt 170 surrounds the port opening in a way that resembles the way the skirt 160 surrounds the heat exchanger plate 100.

When assembled, the port skirt 170 of one port opening of one heat exchanger plate 100 will contact, i.e. overlap, the port skirts of the port openings of neighboring heat exchanger plates. The overlapping port skirts will form a pipe-like configuration in the port opening.

In order to allow fluid flow from the port opening to the flow channels formed by the pressed pattern of the heat exchanger plates, openings 180 are provided in the skirts 170 such that openings in overlapping port skirts of each neighboring pair of heat exchanger plates are aligned as depicted. In FIG. 1, these openings are slightly elliptic, but any shape allowing fluid follow from the port to the flow channels formed by the pressed pattern of the heat exchanger plates can be used. In one embodiment of the invention, the openings extend over the entire height of the skirt, i.e. such that one opening 180 extends from the sealing surface 150 all the way down to the opposite end of the skirt 170.

Figure 2:
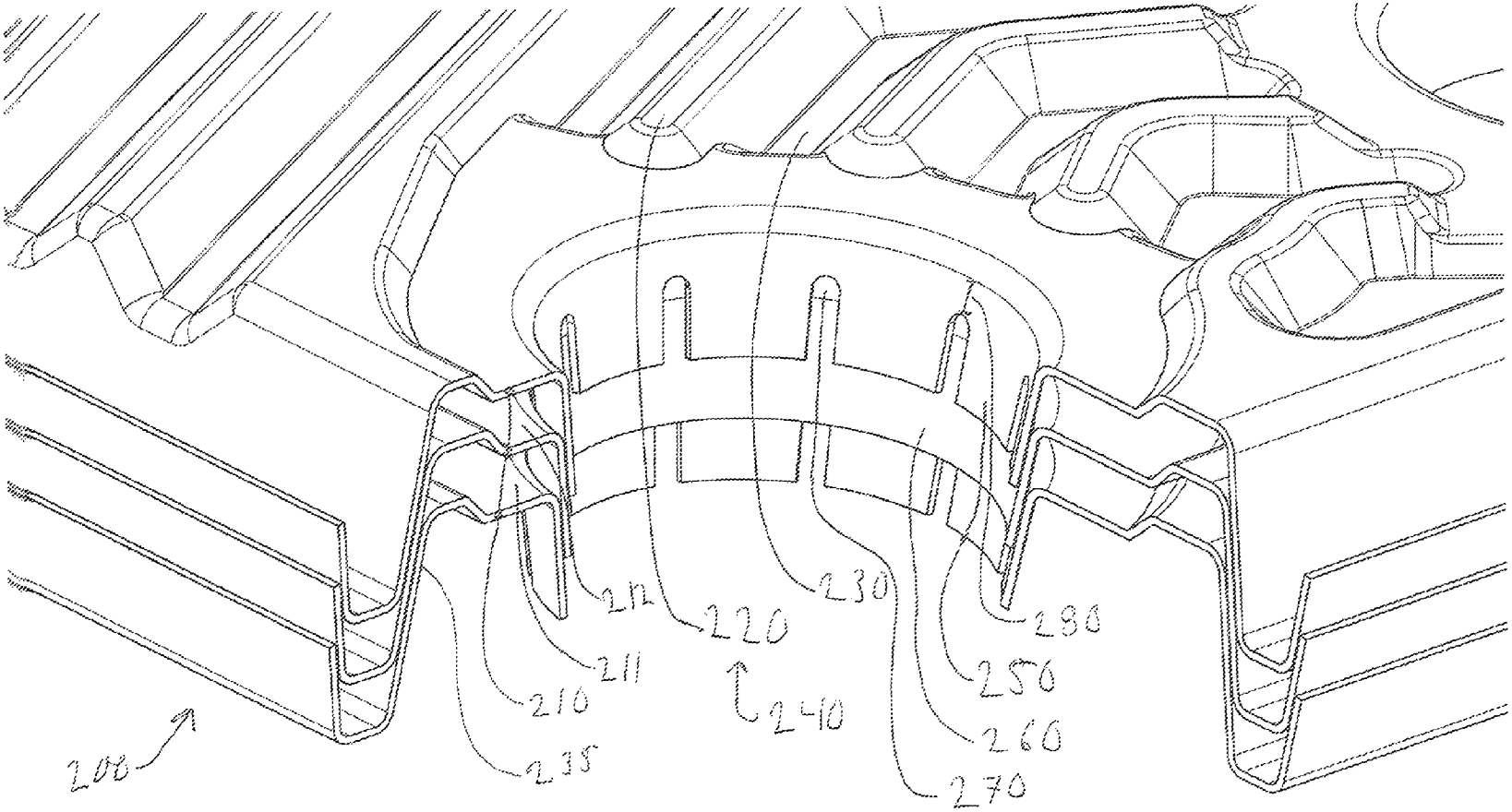
FIG. 2 is a is a partly sectioned perspective view of part of a heat exchanger exhibiting a second embodiment of a port opening according to the present invention

In FIG. 2, another embodiment of a heat exchanger 200 according to the present invention is shown. Just like the heat exchanger according to the first embodiment, the heat exchanger 200 comprises an number of heat exchangers provided with a pressed pattern of ridges and grooves to form flow channels, a skirt 235 surrounding the heat exchanger plate and port openings provided with a port skirt, but the heat exchanger according to the second embodiment differs from the heat exchanger of the first embodiment in that the heat exchanger plates are not provided with sealing surfaces 150.

Still referring to FIG. 2, and as described in general terms above, the heat exchanger 200 according to the second embodiment comprises a number of heat exchanger plates 210, provided with a pressed pattern of ridges 220 and grooves 230 adapted to form flow channels 211, 212 between neighboring heat exchanger plates 210. At least two port openings 240 (only one shown in FIG. 2) selectively communicate with the flow channels formed by the heat exchanger plates, usually such that a pair of port openings communicate with every other flow channel and another pair of port openings communicate with the other flow channels.

Port skirts 250, 260 surround each port opening; the port skirts are arranged such that a port skirt 260 of one heat exchanger plate overlaps port skirts 250 of neighboring plates. The port skirts 250 are provided with openings 270 extending from a lower portion of the skirt to a higher portion of said skirt. There is, however, a sealing portion 280 of the skirt that is not provided with an opening, the sealing portion being provided above the openings 270.

When stacked onto one another, the port skirts 250, 260 will, as mentioned above, overlap one another. This subsequent overlapping of port skirts 250, 260 will make the openings 270 of the port skirts 250, the sealing portion 280 and the port skirt 260 interact such that the port 240 will communicate with every other of the flow channels 211, 212. Starting with the communication between the port opening 240 and the flow channel 212, this communication is arranged by the openings 270. Oppositely, there is no communication between the port opening 240 and the flow channel 211; this communication will be blocked due to the interaction between the sealing portion 280 and the port skirt 280.

By arranging the selective communication between the port opening 240 and the flow channels 211, 212 by providing the port skirts with openings 270 and sealing surfaces 280 cooperating with port skirts 260 without openings, more heat exchanging area can be obtained as compared to the first embodiment.

It should be noted that the port skirts of the first embodiment may be arranged such that they only cover a part of the port opening's circumference, e.g. only the part that faces the pressed pattern of ridges and grooves; by such an arrangement, more load will be transferred through the skirts 160, but the "critical" area when it comes to heat exchangers of the described type, i.e. the area between the port openings, will be considerably strengthened.

The invention claimed is:

1. A brazed heat exchanger for exchanging heat between fluids, the brazed heat exchanger comprising a number of heat exchanger plates provided with a pressed pattern of ridges and grooves, the heat exchanger plates being stacked onto one another such that flow channels are formed between a number of stacked heat exchanger plates, the flow channels being in selective communication with port openings, wherein the port openings each communicate with every other flow channel formed by neighboring heat exchanger plates, wherein port skirts arranged on the heat exchanger plates at least partly surround the port openings, the port skirts extending in a generally perpendicular direction to a plane of the heat exchanger plates, and wherein each port skirt has a first side and a second side and the port skirts are arranged to overlap one another so that for each neighboring pair of heat exchanger plates, one of the first side or the second side of a heat exchanger plate of the neighboring pair of heat exchanger plates extends along the other of the first side or the second side of another heat exchanger plate of the neighboring pair of heat exchanger plates to form a pipe like configuration or a part thereof in the port openings, and wherein the port skirts are arranged to overlap a port skirt of a neighboring plate and extend past a plane of the neighboring plate in an area surrounding the port openings such that overlapping port skirts of the heat exchanger plates in each neighboring pair of heat exchanger plates define a plurality of openings that are aligned with each other so as enable selective communication between the port openings and the flow channels.

2. The heat exchanger of claim 1, wherein only every other port skirt arranged on the number of stacked heat exchanger plates is provided with openings.

3. The heat exchanger of claim 2, wherein the port skirt provided around the port openings also comprises a sealing surface.

4. The heat exchanger of claim 1, wherein the heat exchanger is constructed to keep separate two liquid media.

* * * * *